US008490224B2

(12) United States Patent
Al-Jafar

(10) Patent No.: US 8,490,224 B2
(45) Date of Patent: Jul. 23, 2013

(54) WHEELCHAIR WITH TOILET FOR USE IN A CONFINED AREA WITH A SEWAGE DISPOSAL MEANS

(76) Inventor: Ahmed I. S. I. Al-Jafar, Al-Quran (KW)

( * ) Notice: Subject to any disclaimer, the term of this patent is extended or adjusted under 35 U.S.C. 154(b) by 51 days.

(21) Appl. No.: 13/315,451

(22) Filed: Dec. 9, 2011

(65) Prior Publication Data

US 2013/0145537 A1 Jun. 13, 2013

(51) Int. Cl.
*A47K 11/06* (2006.01)

(52) U.S. Cl.
USPC ..... 4/480

(58) Field of Classification Search
USPC ..... 4/420.1, 420.2, 443, 479, 480, 481
See application file for complete search history.

(56) References Cited

U.S. PATENT DOCUMENTS 5,058,222 A * 10/1991 Workman et al. ..... 4/480
7,562,400 B2 * 7/2009 Graham ..... 4/480

* cited by examiner

*Primary Examiner* — Tuan N Nguyen
(74) *Attorney, Agent, or Firm* — Richard C. Litman

(57) ABSTRACT

An integral toilet and bidet includes a steel frame including a box shaped section and a generally inverted U-shaped upper frame extending upwardly from the rear portion of the box shaped section. A back is extended across the inverted U-shaped upper frame for supporting the back of a patient. A pair of armrest like members extend forwardly from the inverted U-shaped upper frame. One or more tables are connected to the armrest like members. The wheelchair also includes a toilet, a toilet bowl having a relatively small opening in the bottom portion thereof and a bidet disposed in the box shaped section below the first opening. The bidet includes an upwardly directed nozzle for directing water onto a portion of a patient's body and a plurality of downwardly directed nozzles for flushing the toilet.

11 Claims, 3 Drawing Sheets

WHEELCHAIR WITH TOILET FOR USE IN A CONFINED AREA WITH A SEWAGE DISPOSAL MEANS

FIELD OF THE INVENTION

This invention relates to a wheelchair for a disabled patient that includes an integral toilet and bidet and more particularly to a wheelchair for use in a confined area with a sewage disposal such as a sewage line leading from a residence or place of business.

BACKGROUND OF THE INVENTION

Apparatus and devices for aiding disabled individuals to rid themselves of waste are well known and have been in use for many years. For example, U.S. patent of DiMatteo et al., U.S. Pat. No. 4,067,409 discloses a wheel chair arrangement with a seat that may be uncovered to expose an opening that enables a patient to use a toilet while seated in the wheelchair. By actuating a switching arrangement, the patient may raise or lower the back rest to enable the person to be transferred with ease to a bed. A motor operating device may also be actuated by the switching arrangement for uncovering an opening in the seat of the wheelchair and the latter may be wheeled directly over a conventional toilet bowl by motors operated selectively through the switching arrangement actuated by a patient.

A more recent patent of Trkla, U.S. Pat. No. 4,949,408 discloses an all purpose wheelchair. The self-powered wheelchair permits the user to become self-sufficient by permitting the user to move about, relieve themselves of bodily waste, change their own bedpan, exercise, receive intravenous transfer of fluids, change positions and also permits a person to assist the wheelchair user in transferring the wheelchair user from a bed to a wheelchair or from a wheelchair to a bed without the person having to lift the wheelchair user.

Finally, a Convertible Bed/Chair with Waste Disposal is disclosed in a U.S. Pat. No. 6,009,570 of Hangest et al. As disclosed, a bed for patient care having a waste disposal system includes a setback and two leg sections for supporting a patient. These sections of the bed may be raised, lowered and tilted. The leg sections may be moved independently for use with patients having one leg immobilized. The seat sections include two panels which part to permit a waste canister to be raised to interface with the buttocks of the patient. An audible signal alerts the patient prior to this action. In addition, the waste canister provides a directable bidet wash and air drying feature. Gelling material within the canister swells during the bidet function to cover and seal the waste. The entire canister may be sealed and disposed of In addition to the above, there is an additional pending patent application in my name.

The pending application is entitled "Wheelchair with Toilet, Bidet, Waste Storage Tank and Discharge," application Ser. No. 13/271,395, filed on Oct. 12, 2011.

Notwithstanding the above, it is presently believed that there is a need and a potential market for an improved wheelchair in accordance with the present invention. There should be a commercial market for such chairs because they aid wheelchair bound individuals to be self-sufficient, to relieve themselves of body waste without the assistance of another individual, to clean themselves and dry themselves independently. Further, such chairs are rugged, easily serviced, and maneuverable and can be manufactured at a reasonable cost.

BRIEF SUMMARY OF THE INVENTION

In essence a wheelchair with an integral toilet and bidet comprises or consists of a tubular steel frame including a lower box shaped section having front and rear portions and a top portion and a generally horizontal support means for supporting the seat of a patient on top of said box shaped section and means defining an opening in a generally central area of the support means. A generally inverted U-shaped upper frame extends upwardly from said rear portion of said box shaped section and means across said generally inverted U-shaped upper frame for supporting the back of a patient. A pair of forwardly extending and downwardly extending tubular members in the form of armrests with a horizontal portion extending forwardly from said generally inverted U-shaped frame with a vertical portion extending downwardly and into the front portion of the box shaped section. Further, a first generally horizontal removable table is provided between the two forwardly extending tubular armrest like members to allow a patient access to and from the chair. A second foldable table is foldable between a horizontal portion and a folded down portion attached to a first of the forwardly extending tubular members i.e. armrest like members. In addition, a third foldable table is foldable between the horizontal position and a folded down position and is attached to the second of the forwardly extending armrest like members.

The wheelchair also includes a toilet, a toilet bowl having a relatively small opening in the bottom portion thereof and a bidet disposed in said box shaped section below said first opening and wherein said bidet includes an upwardly directed nozzle for directing water onto a portion of a patient's body. A plurality of downwardly directed nozzles for flushing the toilet and cleaning the toilet basin are also provided. The wheelchair also includes a first conduit and a quick disconnect connection for connecting the bidet to a source of clean water, a second conduit and a second quick disconnect connection for connecting said second opening to a sewage disposal line from a residence or office. The wheelchair also includes an electric wire or cable and plug for connecting the chair to a source of electricity for energizing various components of the chair.

There is also a closeable opening between the second opening and the sewage disposal line and means for eliminating the odor from human waste.

Further, the wheelchair includes a pair of relatively large wheels with one of the wheels rotatably fixed to each side of the rear portion of the box shaped section as well as a pair of relatively small wheels rotatably and swivably mounted in front of the relatively large wheels and rotatable about a first axis and swivable about a second axis and are mounted to a front portion of the box shaped section of the frame.

In addition to the above, a reading light is adjacent one of the forwardly extending tubular members and a control panel with a light switch, speakers and flush and dryer control members are attached or fixed to one of the tables.

The invention will now be described in connection with the accompanying figures wherein like reference numerals have been used to indicate like parts.

DESCRIPTION OF THE PREFERRED EMBODIMENTS OF THE INVENTION

Figure 1:
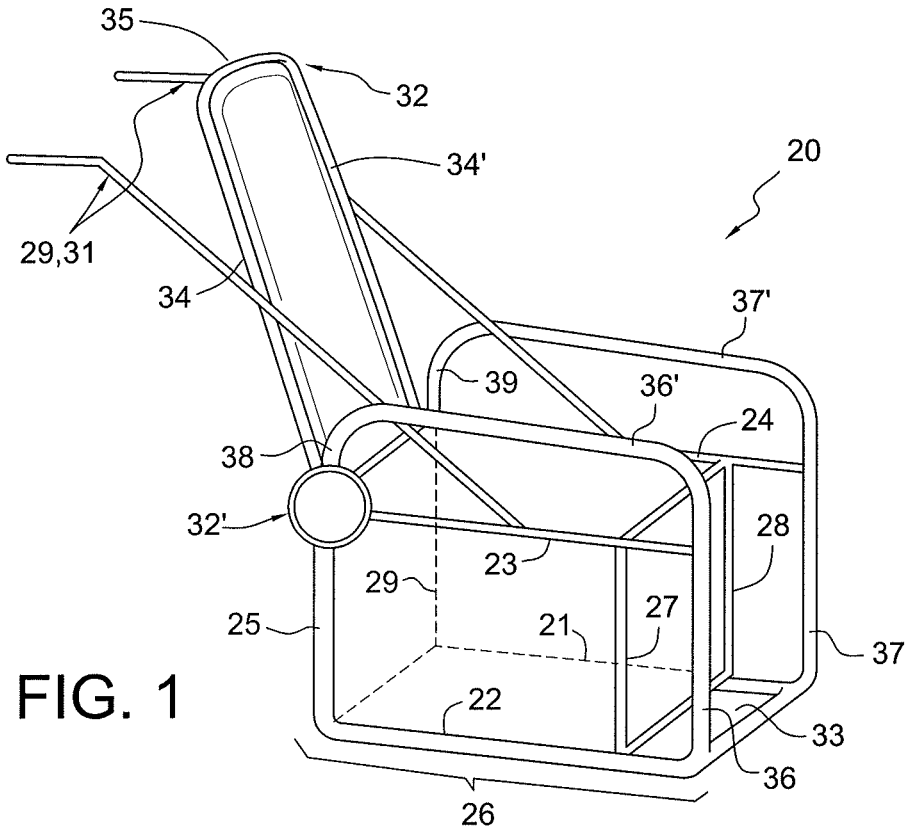
FIG. 1 is a schematic illustration of a frame assembly for a wheelchair in accordance with a first embodiment of the invention.
Figure 2:
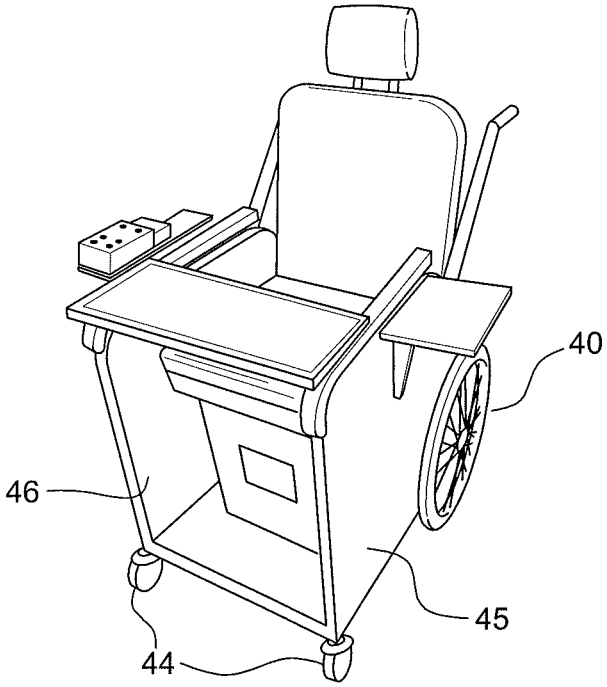
FIG. 2 is a perspective view of a wheelchair in accordance with a first embodiment of the invention taken from the front of the chair.

As illustrated in FIGS. 1 and 2, a wheelchair in accordance with a preferred embodiment of the invention comprises a structural frame 20 that includes four generally horizontal tubular metal frame members 21, 22, 23, and 24 and four vehicle tubular members 25, 27, 28, and 29 to form a box shaped section 26. The tubular frame members are preferably steel or aluminum with about a 1 inch diameter and sufficient wall thickness to support up to about 300 pounds in a chair structure. The tubular members are typically welded together to form the box like structure 26 with a forward portion 30 and rear portion 32.

The frame 20 also includes an upwardly extending generally inverted U-shaped back support 34 that includes a pair of upwardly extending tubular members 34 and 36 with an upper cross member 35. In a first embodiment of the invention, the inverted U-shaped body support is in a fixed position as for example by being the upwardly extending tubular member welded to the rear upper portion of the box shaped section 26. However, in a second embodiment of the invention the back rest is rotatable to provide a semi-reclining position as for example by being rotatable about a reclining mechanism shown schematically at 32. In practice any conventional mechanism for a reclining chair may be used.

In the preferred embodiment of the invention the forwardly extending lower frame member at the bottom of the box shaped section 26 extends forwardly from the box shaped section and forms a base or footrest 33. The upper horizontal tubular members 23 and 24 terminates in two vertical tubular members 36' and 37' in the form of arm rests that include a pair of downwardly extending portions 38 and 39.

Figure 3:
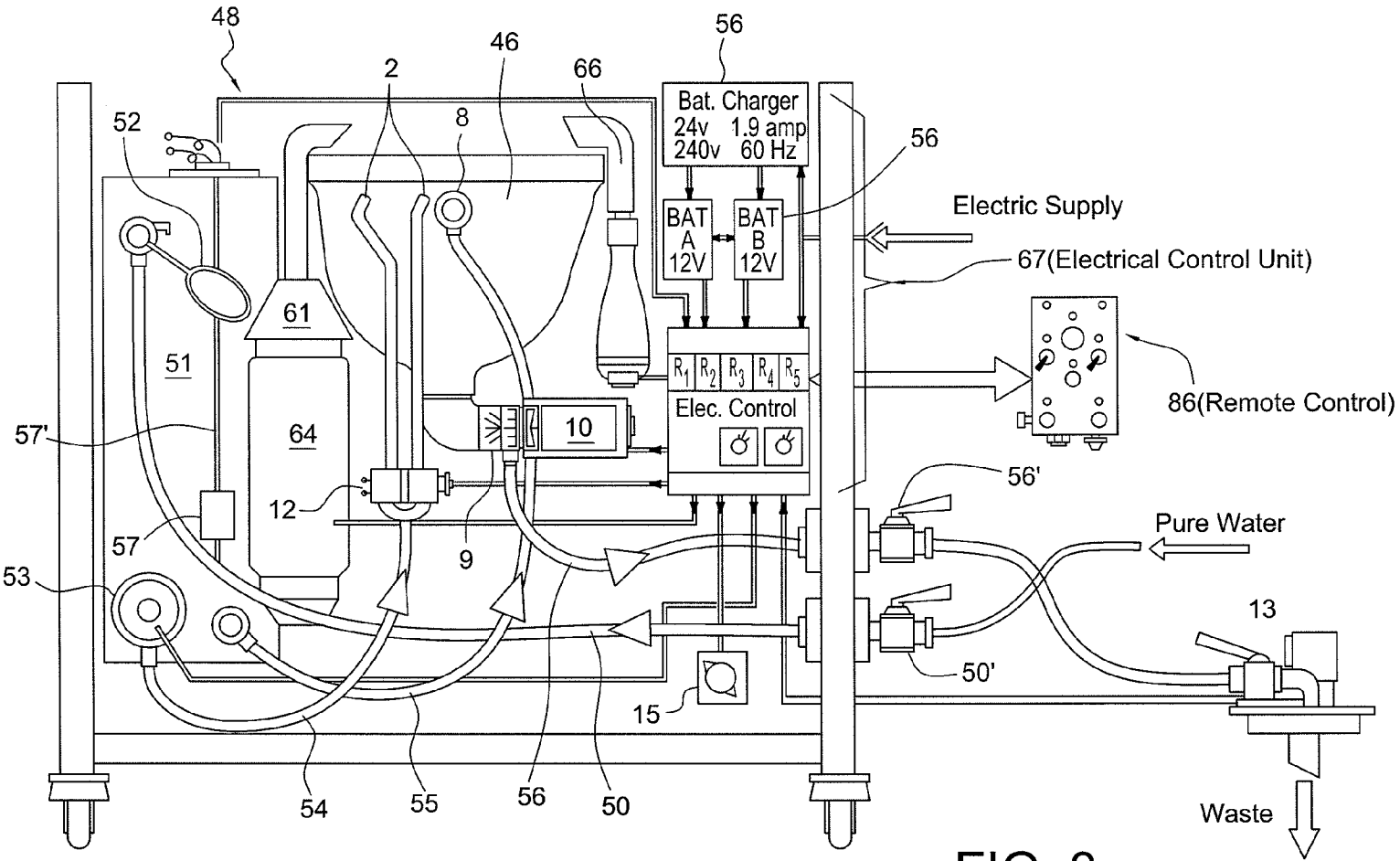
FIG. 3 is a schematic illustration of a toilet module as used in the present invention.

As shown in FIGS. 2 and 3, the wheelchair 20 includes a pair of rotatable large wheels 40 and 41 with one wheel rotatably mounted on one side of a rear portion 32 of the box shaped section 26 and the second wheel 41 rotatably mounted on the other side of the rear portion 32 of the box like section 26. The chair also includes a pair of relatively small rotatable and swivable wheels 44 positioned on the forward extension of the tubular frame member 21 and 22 under the footrest 33. The swivable wheels 44 are generally swivable about a vertical axis.

As shown in FIG. 3 the wheel chair 20 includes a pair of side panels 45 and 46 that extend downwardly from the armrest like tubular members 36' and 37' to the bottom of the box like section 26. These side panels 45 and 46 and a rear panel (not shown) provide privacy for a patient plus the use of a sheet or blanket provides privacy for the patient when relieving their self. However, it is also contemplated by the invention that a patient will use the wheelchair 20, transport ones self to a small bathroom or privacy room equipped with a quick disconnect connection fitting and a convenient electrical outlet to use the privacy room for privacy.

As illustrated in FIG. 3 the wheel chair 20 includes a toilet/bidet module 48 disposed within the box shaped frame section 26.

The toilet/bidet module 48 includes:

A bowl 46 with an integral worker conduit along its inner circumference conveys clean water into the bowl for flushing the toilet;

Two upwardly directed nozzles 2 fixed to the bowl 46 for personal cleaning, i.e. one nozzle is provided for the posterior part of the user's body while the other nozzle is provided for the anterior part of the body, the nozzles are fed by water through a controllable two way valve 12, such that, only one of the nozzles is fed at a time;

clean water tank or reservoir 51 is connected to a source of clean water through valve 57, hose 50 and a float valve 52 that prevents the reservoir 51 from being over filled;

Water pump 53 derived by a controllable variable speed electrical motor feeds the cleaning nozzles 2 through the hose 54 and the two way valve 12;

a multifunction pump 9 driven by electric motor 10, consists of two sections isolated from each other but rotates by the same shaft. The first section sucks clean water from the reservoir 51 through hose 55 and flushes it into the bidet bowl 46 through its integral conduit and an inlet 8. The second section of the multifunction pump consists of two cascaded sub-sections, the outer sub-section sucks the flushed water and the waste from the bidet bowl 46 and blends them to produce a liquefied waste, and the next sub-section pumps the liquefied waste to a residence sewage drain through hose 56 and valve 56'.

A vacuum 64 and carbon filter 61 are used for deodorizing the toilet;

A dryer 66 blows hot air under a toilet seat (not shown) for drying an individual after using the bidet and removes any remaining water from the individual;

And, an electrical control unit 67 that is operable from a remote control unit 68, the control unit 67 drives all the electrical equipment included in the toilet/bidet module 48.

Safety and alert features are added to the toilet/module 48, namely:

The water tank 51 includes a float 57 which is guided by a stainless steel vertical shaft 57', the shaft 57' has a built-in proximity switch positioned at a height near the bottom of tank 51, the proximity switch senses the presence of the float if the water level in thank 51 drops to its height and will actuate an alert light/buzzer in the remote control unit 68;

The waste discharge line ends by a valve 13, which is always open and only closed during transporting the chair, the position of valve 13 is sensed by a mechanical switch, the later actuates an alert signal in the remote control unit 68 as long as the valve 13 is in the closed position;

And a push button switch in the remote control 68 actuates a high alarm buzzer or wireless bell is to be used by a person when he needs help.

Figure 4:
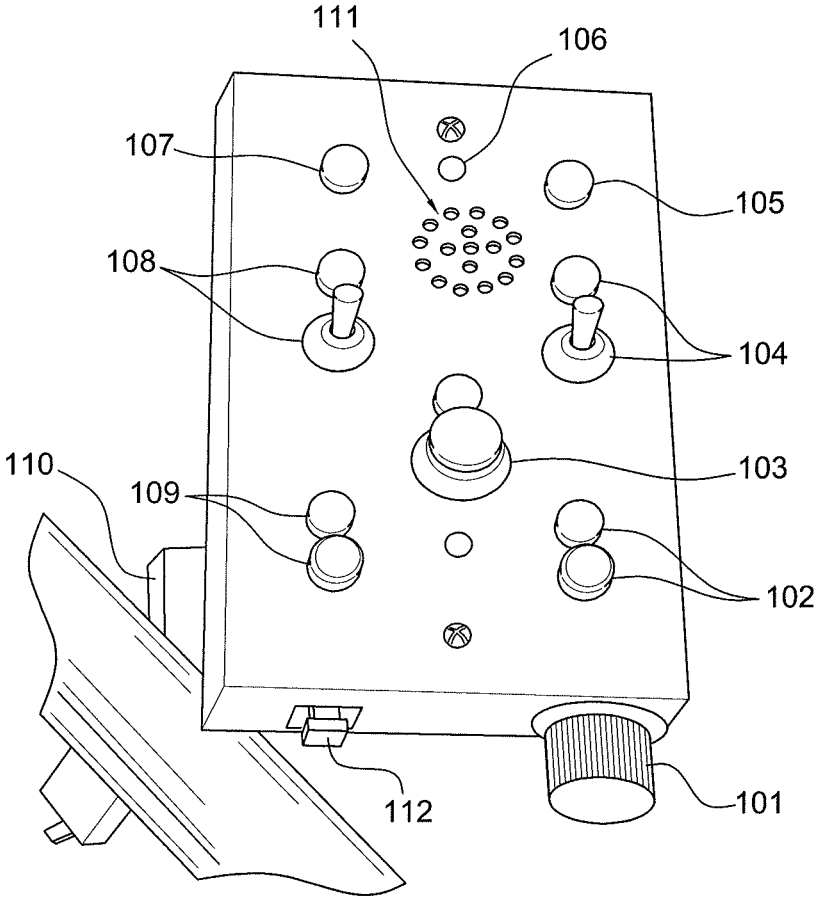
FIG. 4 is a schematic view of a control unit for use with a wheelchair in accordance with one embodiment of the invention.

The remote control unit 68 is shown in more detail in FIG. 4. As shown the control unit 68 includes:

A potentiometer circuit 101 for increasing or decreasing the water pressure used in cleaning the individual;

A Push Button and indicating LED light 102 activates the two way valve 12 in the toilet module 48 to direct the cleaning water to the front nozzle;

A second push button and LED light 103 activates the pump 9 to start the flush and discharge action;

A toggle switch and LED 104 activate and indicate the deodorizer;

An alert red LED light 105 indicates that the discharge valve 13 is closed;

A dual color LED 106 (red/green) indicates that the battery is charging or battery is charged;

An alert LED light 106 indicates that the water level in tank 51 has reached the lower 15, level;

A toggle switch and indicating LED light 108 is used for the operation of the hot air drier 66;

A push button and indicating LED light 109 activates the two way valve 12 in the toilet module 48 to direct the cleaning water to the back-side nozzle;

A push button is used to signal the need for assistance;

And finally, push button 112 activates an audio signal 15 (FIG. 3) for a more urgent call for assistance.

While the invention has been described in connection with its preferred embodiments it should be recognized that changes and modifications may be made therein without departing from the scope of the appended claims.

What is claimed is:

1. A wheelchair with an integral toilet and bidet, said wheelchair comprising:

a tubular steel frame including a lower box shaped section having a front portion and a rear portions and a top portion and a generally horizontal support means for supporting the seat of a patient on top of said box shaped section and means defining an opening in a center area of said support means;

a generally inverted U-shaped upper frame extending upwardly from said rear portion of said box shaped section and means across said generally inverted U-shaped upper frame for supporting the back of a patient;

a pair of forwardly and downwardly extending tubular members in the form of armrests with a horizontal portion extending forwardly from said generally inverted U-shaped frame and a vertical portion extending downwardly and into said front portion of said box shaped section;

a first generally horizontal removeable table between said forwardly extending tubular armrest like members to allow a patient access to said chair, a second foldable table foldable between a horizontal position and a folded down position attached to a first of said forwardly extending tubular members;

a third foldable table foldable between a horizontal position and a folded down position attached to the second of said forwardly extending (armrest like) members;

a toilet including a toilet bowl having a relatively small opening in a bottom portion thereof and a bidet disposed in said box shaped section below said first opening and wherein said bidet includes an upwardly directed nozzle for directing water onto a portion of a patient's body and a plurality of downwardly directed nozzles for flushing said toilet and cleaning said toilet bowl;

a first conduit and a quick disconnect connector for connecting said bidet to a source of clean water, a second conduit and a second quick disconnect connector for connecting said second opening to a sewage disposal line and an electrical wire or cable and plug for connecting said chair to a source of electricity for energizing various components of said chair;

a closeable opening between said second opening and said sewage disposal and means for eliminating odor from human waste; and a pair or relatively large wheels, one of said wheels rotatably fixed to each side of said rear portion of said box shaped section of said frame and a pair of relatively small wheels mounted in front of said relatively large wheels rotatable about a first axis and swivable about a second axis perpendicular to said first axis attached to a front portion of said box shaped section of said frame; and a reading light adjacent one of said forwardly extending tubular members and a control member with a light switch, speaker, flush and dryer controls.

2. A wheelchair with an integral toilet and bidet according to claim 1 which includes a hot air dryer.

3. A wheelchair with an integral toilet and bidet according to claim 2 which includes a potentiometer circuit to regulate the water pressure for personal cleaning.

4. A wheelchair with an integral toilet and bidet according to claim 3 which includes a pair of 12 volt batteries and a battery charger for charging said batteries.

5. A wheelchair with an integral toilet and bidet according to claim 4 which includes a deodorizer having a carbon filter and a vacuum for drawing air through a said filter surrounding air through said filter.

6. A wheelchair with an integral toilet and bidet according to claim 5 which includes a foldable table attached to each forwardly extending tubular member and a fold away table extending across the front of said chair.

7. A wheelchair with an integral toilet and bidet according to claim 6 which includes a communication device for communicating with an assistant.

8. A wheelchair with an integral toilet and bidet according to claim 7 which includes a reading light attached to a rear portion of said chair and adjustable for illuminating a book in the hands of an individual in said chair.

9. A wheelchair with an integral toilet and bidet according to claim 8 which includes a sound system for listening to a radio or recorded music.

10. A wheelchair with an integral toilet and bidet according to claim 3 which includes a multi-function pump and an electric motor for drawing clean water from said reservoir and flushing it into said bidet and blending it to produce liquefied waste and pumping the liquefied waste into a sewage drain.

11. A wheelchair with an integral toilet and bidet, said wheelchair consisting of a tubular steel frame including a lower box shaped section having a front portion and a rear portions and a top portion and a generally horizontal support means for supporting the seat of a patient on top of said box shaped section and means defining an opening in a center area of said support means;

a generally inverted U-shaped upper frame extending upwardly from said rear portion of said box shaped section and means across said generally inverted U-shaped upper frame for supporting the back of a patient;

a pair of forwardly and downwardly extending tubular members in the form of armrests with a horizontal portion extending forwardly from said generally inverted U-shaped frame and a vertical portion extending downwardly and into said front portion of said box shaped section;

a first generally horizontal removeable table between said forwardly extending tubular armrest like members to allow a patient access to said chair, a second foldable table foldable between a horizontal position and a folded down position attached to a first of said forwardly extending tubular members;

a third foldable table foldable between a horizontal position and a folded down position attached to the second of said forwardly extending (armrest like) members;

a toilet including a toilet bowl having a relatively small opening in a bottom portion thereof and a bidet disposed in said box shaped section below said first opening and wherein said bidet includes an upwardly directed nozzle for directing water onto a portion of a patient's body and a plurality of downwardly directed nozzles for flushing said toilet and cleaning said toilet bowl;

a first conduit and a quick disconnect connector for connecting said bidet to a source of clean water, a second conduit and a second quick disconnect connector for connecting said second opening to a sewage disposal line and an electrical wire or cable and plug for connecting said chair to a source of electricity for energizing various components of said chair;

a closeable opening between said second opening and said sewage disposal and means for eliminating odor from human waste; and a pair or relatively large wheels, one of said wheels rotatably fixed to each side of said rear portion of said box shaped section of said frame and a pair of relatively small wheels mounted in front of said relatively large wheels rotatable about a first axis and swivable about a second axis perpendicular to said first axis attached to a front portion of said box shaped section of said frame; and a reading light adjacent one of said forwardly extending tubular members and a control member with a light switch, speaker, flush and dryer controls.

* * * * *